United States Patent [19]

Strick

[11] Patent Number: 4,912,376

[45] Date of Patent: Mar. 27, 1990

[54] TIMED ACTUATOR FOR CONVENTIONAL WALL SWITCH

[76] Inventor: Robert E. Strick, 5456 Harpers Farm Rd., Columbia, Md. 21044

[21] Appl. No.: 192,643

[22] Filed: May 11, 1988

[51] Int. Cl.[4] ..... H05B 37/02; H01H 3/00

[52] U.S. Cl. ..... 315/362; 315/159; 200/17 R; 307/139; 307/141

[58] Field of Search ..... 315/362, 149, 159; 307/139, 140, 141, 141.4; 200/17 R

[56] References Cited

U.S. PATENT DOCUMENTS 3,985,982 10/1976 Schneidinger ..... 200/33 R
4,645,942 2/1987 Nilssen ..... 307/140
4,835,413 5/1989 Nilssen ..... 307/141

*Primary Examiner*—David Mis
*Attorney, Agent, or Firm*—Howard Alan Taishoff

[57] ABSTRACT

A timed actuator moves the switch mechanism of a conventional wall switch. The actuator is detachably secured to the wall switch in abutting relation thereto. The actuator includes a small electric motor, a programmable timer, and several relays. Linkage, driven by the motor, engages the switch mechanism. The programmable timer drives the relays and the latter controls application of current to the motor. At preset times, current is applied to the motor causing the linkage to move the switch mechanism from one extreme of its travel to the other.

4 Claims, 2 Drawing Sheets

TIMED ACTUATOR FOR CONVENTIONAL WALL SWITCH

This invention relates to a timed actuator for the switch mechanism of a conventional wall switch.

The unattended and automatic 'on' and 'off' cycling of lights in an unoccupied home has a known anti-crime effect. It creates the illusion that somebody is present. There are many common devices for timed automatic control of lamps and switches. Usually these common store-bought timers feed off of conventional AC current. They are electromechanical in operation and usually employ a small AC motor to operate a switch in series with the AC power going to the controlled appliance or light. Most often they are supplied as a stand-alone unit that includes a built-in AC receptacle and an extending power cord and plug. Although the type of timed control afforded is not very flexible, they are simple to operate and their cost is low. Another such type is a more sophisticated electronic remote controlled device that uses a wireless link or the AC power lines as the link between a stand-alone programmable timer and a remotely controlled modular switch. These timers afford great flexibility of control but at a significantly higher price. However, a noticeable drawback of either the electromechanical timer or the all electronic device is that they can not be used for control of a conventional wall switch.

But there are devices that mimic the operation of a conventional wall switch and that, in one form, provide for timed operation of the controlled appliance (i.e., the light), or provide a dimmer function, or both. Several of these circuit timers and dimmers are also rather sophisticated in their operation employing involved logic and power controlling devices (SCRs, triacs, high voltage and high current bipolar transistors, power FETs, etc.). But irrespective of the level of sophistication attained they all have one significant drawback—they require hard wiring into the switch box that supports the switch and supplies electric power to the light. Thus for the average consumer or home-owner, programmable control of, say, a ceiling mounted, internally wired fixture is not available unless one is capable of working with the AC mains that pass through the wall mounted switch box. And, even for the technically proficient, working with the AC mains is hazardous.

The present invention overcomes all of the problems and hazards noted above and provides for a timed actuator that operates the switch mechanism of a conventional wall switch. In general the inventive timed control includes a small motor or actuator which is carried on a platform. Preferably, the platform detachably affixes to the switch unit or cover plate by one or both of the screws used to secure the cover plate to the switch box. In one embodiment the motor includes means which converts the rotary motion of the motor into a small linear displacement. One end of an intermediate link assembly engages that part of the switch mechanism that protrudes from the cover plate. The other end of the link assembly is driven by the motor. A programmable timer drives a switching circuit and the latter controls application of battery power to the motor for a short duration. These shorts bursts of battery power to the motor causes the link assembly to move between a relatively extended position driving the switch mechanism to one extreme of its travel, and a relatively contracted position driving the switch mechanism to its other extreme of travel. Therefore, at predetermined programmed intervals the switch and hence light is turned on and off. Moreover, a wireless link is easily integrated into the aforesaid switching circuit for manual remote control.

It is therefore an object of the present invention to provide a self-contained mechanism that can be detachably secured to the cover plate of a conventional wall switch for timed actuation of the protruding switch mechanism or lever.

It is an other object of the present invention to provide an actuator for an existing wall mounted switch wherein the actuator operates to provide timed control of the switch, readily attaches thereto and does not require electrical connection to the AC mains being switched.

It is a further object of the present invention to provide a timed control for a conventional wall switch wherein the control detachably affixes to the switch unit and which operates the switch at predetermined intervals for an anti-crime effect.

It is another object of the present invention to provide a motor driven control for a conventional wall switch wherein the control can be operated by a wireless link.

Other objects and features of the present invention will become apparent from the following detailed description considered in connection with the accompanying drawings. It is to be understood, however, that the drawings are designed for purposes of illustration only and not as a definition of the limits of the invention for which reference should be made to appending claims.

In the drawings, wherein the same reference numeral denotes the same element throughout the several figures.

Figure 1:
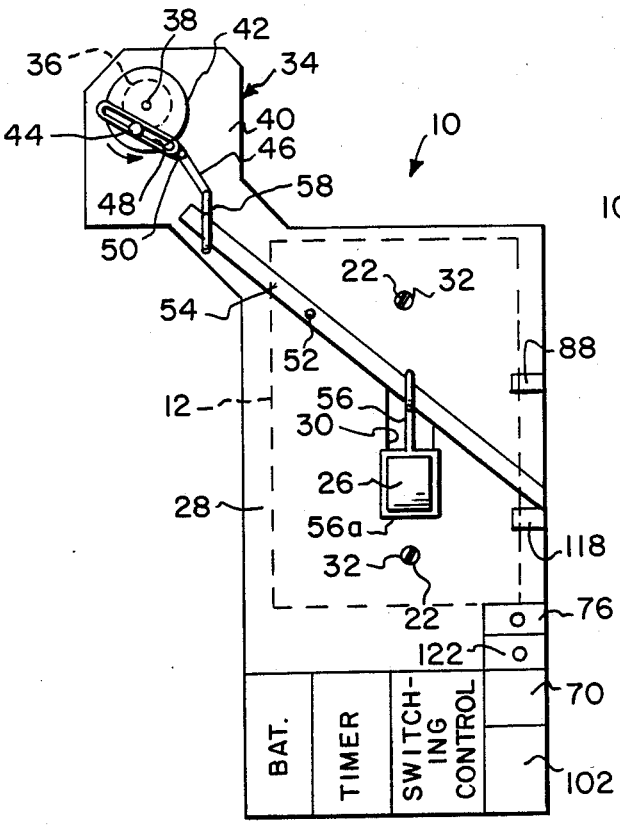
FIG. 1 is a diagrammatic front view showing the inventive timed actuator attached to a conventional wall switch.
Figure 2:
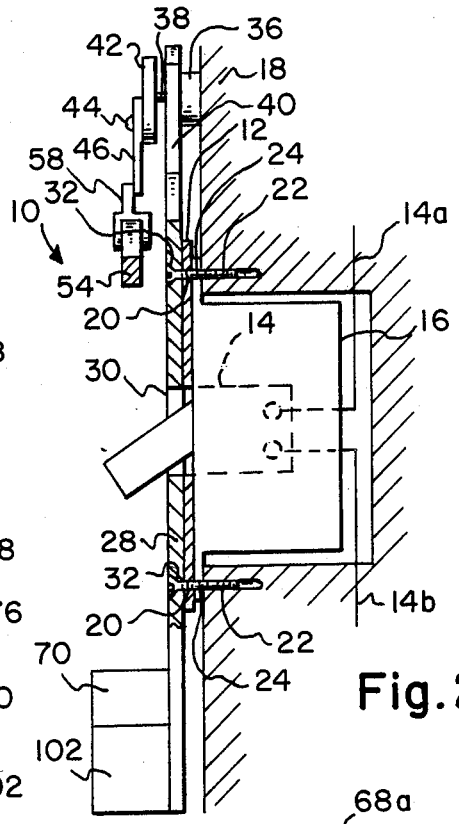
FIG. 2 is a diagrammatic side view of that seen in FIG. 1.

In detail now an referring to the drawings, FIGS. 1 and 2 show the inventive timed actuator or device indicated generally as reference numeral 10. As will be described below, actuator 10 is brought up flush against a cover plate 12 of a conventional wall switch unit 14 and detachably affixed to either plate 12 or switch unit 14, or both. Wall switch 14 is carrie in a switch box 16, and the latter is secured in a wall 18. Switch 14 is fed by AC power leads **14*a* and 14*b*. Cover or face plate 12 is supplied with two spaced apertures 20. As is common practice, plate 12 is detachably secured to box 16** by a pair of screws 22. Screws 22 are received through respective apertures 20 and engage an associated tapped aperture 24 in front facing flanges of box 16. Switch 14 includes a means 26 for manually activating the switch. Such means is usually in the form of a small lever that protrudes from cover plate 12 when the switch is a conventional toggle, but such means also includes nearly flush mounted rockers, rotary dials, slide switches, push-buttons, and the like.

Inventive actuator 10 includes a housing or support plate 28 formed with a switch cut-out 30. A pair of spaced apertures 32 straddle cut-out 30. The spacing between apertures 32 correlates or aligns with the position of conventional apertures 20 in cover plate 12. During use and operation of the invention as will be described below, screws 22 that support cover plate 12 are removed. Housing 28 is brought up flush against the cover plate. Screws 22 are then passed through housing 28, switch plate 12, and into respective tapped apertures 24. With this construction and when housing 28 is detachably affixed over cover plate 12, switch lever 26 protrudes through cut-out 30 as seen in FIGS. 1 and 2.

Housing 28 carries a small motor assembly 34. Assembly 34 includes a motor 36 having a drive shaft 38. Motor 36 is, preferably, DC operated and is supported by a plate 40 with drive shaft 38 of the former extending through the latter. Shaft 38 drives conventional apparatus for converting the rotary motion of the motor to a linear displacement. Briefly this apparatus includes a drive plate 42 affixed on the shaft. A peg 44 extends from the outboard face of plate 42. A follower link 46 with an extending longitudinal cut-out 48 pivots on and is supported by a pivot pin 50.

In the inventive apparatus, a pivot pin 52 extends from the outboard face of plate 28. A rigid link 54 is supported by and pivots on pin 52. A link 56 has one end, end 56*a*, formed so as to engage and drive switch lever 26. In the embodiment shown this end is seen as a ring. But other constructions are readily apparent for driving lever 26. One such would be a double "L" configuration on the noted end of link 56. The important criteria in choosing the form of end 56*a* is that this end be capable of engaging the mechanism and driving it reliably. The other end of link 56 is pivotally coupled to one end of link 54. The other end of link 54 is pivotally coupled to one end of a drive link 58. The other end of this last-mentioned link is pivotally coupled to the free distal end of follower link 46. With this structure, rotary motion of motor shaft 38 is converted into small controlled linear "up" and "down" movements of link 56 and hence, during use and operation of the invention as will be described below, "off" and "on" movements of switch lever 26.

Figure 3:
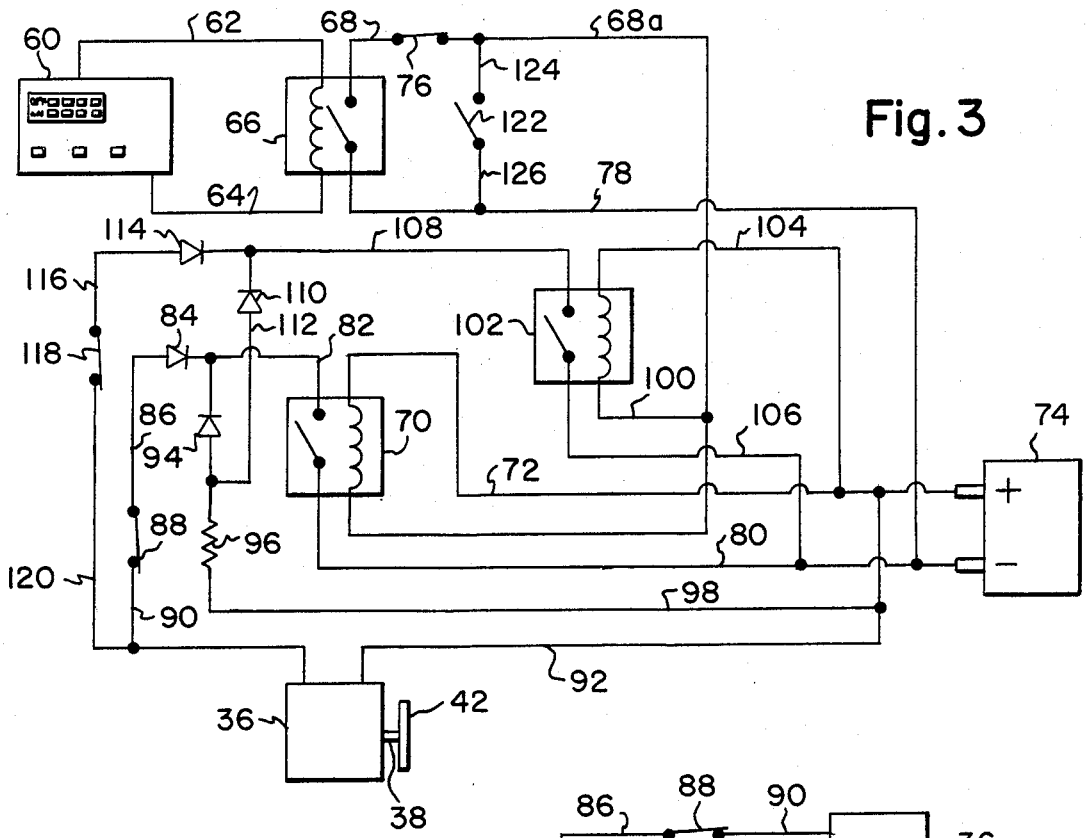
FIG. 3 is an electrical schematic of the present invention.

Referring now to FIG. 3, there is shown an electrical schematic of the circuitry of the inventive apparatus. A conventional off-the-shelf programmable timer 60 has two output leads 62 and 64 connected across the respective ends of the solenoid coil of a timer driven relay 66. A lead 68 connects one pole or contact of normally open relay 66,to one side of a normally closed, manually operated override switch 76. A lead 68*a* connects the other side switch 76 to one side of the solenoid coil of an on-cycle relay 70. A lead 72 couples the other side or end of this last-mentioned coil to the positive terminal of a battery 74. A lead 78 connects the other pole or contact of relay 66 to the negative terminal of battery 74. A lead 80 connects one contact of on-cycle relay 70 to the negative terminal of the battery. A lead 82 connects one contact of relay 70 to the cathode of a diode 84. A lead 86 connects the anode of diode 84 to one side of a normally closed microswitch 88. The other side of microswitch 88 is connected to one side or the negative terminal of motor 36 by a lead 90. As seen in FIGS. 1 ad 2, switch 88 is carried on plate 28 where it can be tripped by lever 54 when switch lever 26 reaches one extreme of its travel during use and operation of the invention as will be described below. A lead 92 couples the other side or the positive terminal of the motor to the positive terminal of battery 74.

The cathode of a light emitting diode (LED) 94 is connected to lead 82. One side of a resistor 96 is connected to the anode of LE 94 and the other side of the resistor is connected to the positive terminal of the battery by means of a lead 98.

A lead 100 connects one side of the solenoid coil of a normally closed off-cycle relay 102 to lead 68*a*. Another lead 104 connects the other side of this last-mentioned solenoid coil to the positive terminal of battery 74. A lead 106 connects one side or one contact of relay 102 to the negative terminal of battery 74. Another lead 108 connects the other side or contact of relay 102 to the cathode of a LED 110. A lead 112 connects the anode of LED 110 to the junction of resistor 96 and the anode of LED 94. The exact value of resistor 96 is not critical since it merely functions to limit current through LEDs 94 and 110. Approximately 220 ohms is a suitable value for the resistor. The cathode of a diode 114 is connected to lead 108. A lead 116 connects the anode of this diode to one side of a normally closed microswitch 118. As seen in FIGS. 1 and 2, switch 118 is carried on plate 28 at a position where the same can be tripped by the movement of lever 54 when switch lever 26 reaches the other extreme of its travel, which will be explained in detail below. A lead 120 connects the other side of this last-mentioned switch to the negative terminal or pole of motor 36.

A lead 124 connects one side or contact of a "manual control" switch 122 to lead 68*a*. The other side of switch 122 is connected to lead 78 by means of a lead 126. Switch 122 is normally open and placed across the contacts of timer relay 66. The switch is used for manual override during use and operation of the invention as will be described now.

Figure 4:
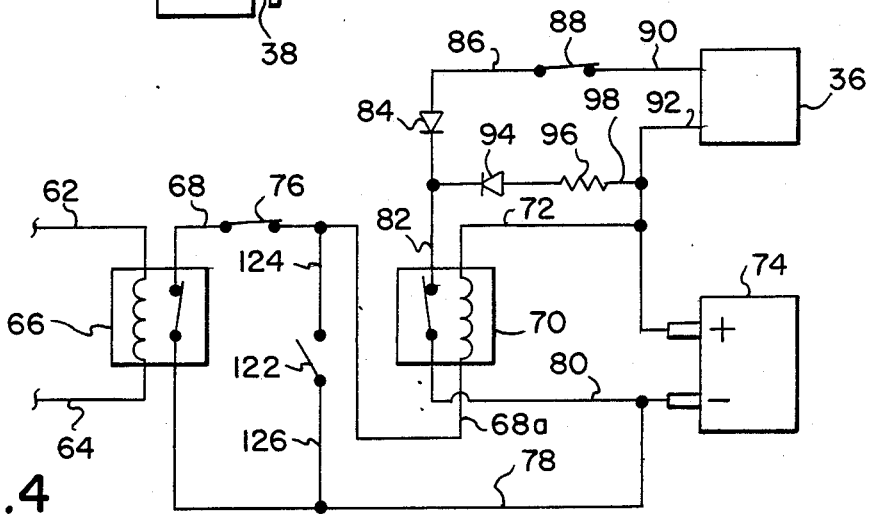
FIG. 4 shows that part of FIG. 3 that i used in driving the wall switch to one extreme of its travel or its 'on' position.

In use and operation, timer 60 is programmed for a given "on" time and a given "off" time. At the aforesaid "on" time, and now reference is made to FIGS. 3 and 4, a given voltage is applied across leads 62 and 64, which in this case is approximately 9 volts. This energizes the solenoid coil of relay 66 causing the contacts of relay 66 to close. Current flows through the contacts of relay 66 from lead 78 to lead 68 and then through switch 76. Switch 76 is a normally closed "in/out" mode switch whose operation will be described hereinafter. When this switch is closed, current flows through lead 68*a* supplying negative voltage to one side of respective relay coils 70 and 102. Circuit is completed through the coil of relay 102 by lead 104 connected to battery positive Circuit is completed through the coil of relay 70 by lead 72 which is also connected to battery positive. Thus during this "on" time both relays 70 and 102 are energized.

As noted, relay 70 is normally open but since it is now energized, its contacts close and current flows from lead 80 to lad 82 through diode 84. Lead 86 takes current from diode 84 and applies it to switch 8 which is normally closed. Lead 90 applies this negative voltage to the negative terminal of motor 36. LED 94 (preferably green) is connected in parallel with lead 82 and is in series with resistor 96 to the positive terminal of battery 74. Current now flows through LED 94 lighting the same. LED 94 thus acts an an indicator that current is flowing through the contacts of relay 70. Motor 36 which has its positive pole connected to battery positive by lead 92 is now energized and causes drive plate 42 to revolve, bringing with it peg 44. Angular movement of peg 44 pivots link 46. Link 46 moves downwardly, when viewing FIG. 1, taking with it link 58. It will be realized that downward movement of the last-mentioned link pivots link 54 causing link 56 to move relatively upwardly. Since one end of link 56 is attached to switch lever 26, lever 26 moves upwardly turning on wall switch 14. As plate 42 revolves 180 degrees and lever 26 is brought relatively upwardly, the free end of link 54 is brought into engagement with microswitch 88 causing the contacts of same to open. This interrupts the current to motor 36 thereby causing wall switch 14, motor 36, and associated linkage to rest in the "on" position and prevent unwanted rapid on/off cycling of switch 14.

Figure 5:
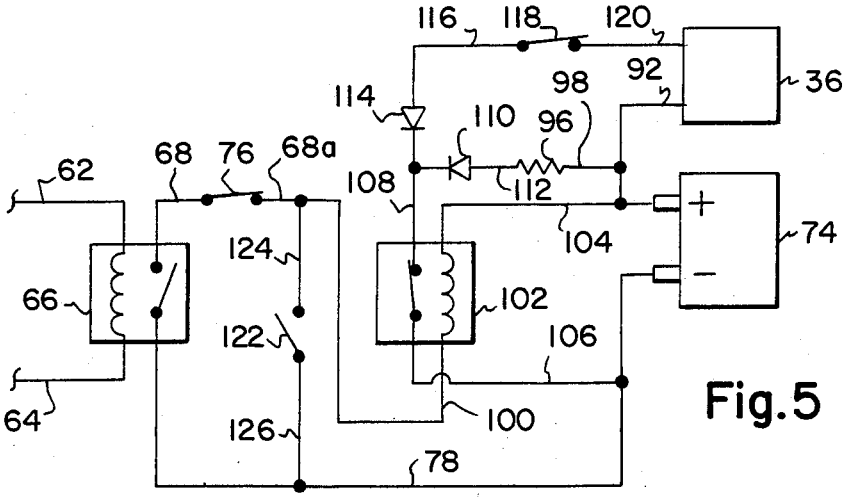
FIG. 5 shows that part of FIG. 3 that is used in driving the wall switch to the other extreme of its travel or its 'off' position.

After a predetermined interval timer 60 will reach its preprogrammed "off" time. At such time, the timer interrupts the flow of current along leads 62 and 64. This de-energizes the soleniod coil of timer relay 66 opening the contacts of same. Now, with reference made to FIG. 5, the opening of these contacts interrupts continuity between leads 68 and 78. This interrupts the flow of current through the soleniod coils of relays 102 and 70 causing the contacts of the former mentioned relay to close and the latter mentioned one to open. A negative potential (continuity) is now applied (established) from the negative terminal of battery 74 through lead 106 and then through the now closed contacts of relay 102. Lead 108 conducts this negative potential to diode 114 forward biasing the same whereupon lead 116 couples the negative potential (current) to normally closed switch 118. Lead 120 completes continuity to the negative terminal of motor 36. Since lead 92 couples the positive pole or terminal of motor 36 to the positive terminal of battery 74, current flows from the battery through the motor turning the latter "on." Operation of motor 36 causes drive plate 42 to resume revolving in its given direction which now causes peg 44 to drive link 46 relatively upwardly when looking at FIG. 1. It will be apparent that such movement is eventually translated into a relatively downward displacement of link 56. Since link 56 remains coupled to lever 26, lever 26 is lowered turning switch 1 "off." As this occurs, the free end of lever 54 engages off-cycle interrupt switch 118. This opens the contacts of same and interrupts continuity between leads 116 and 120. The interruption of electrical continuity between the aforesaid leads, stops application of current through motor 36. With the motor off, the linkage and wall switch rest in the "off" position. As with microswitch 88, microswitch 118 also prevents unwanted rapid off/on cycling of switch 14.

When relay 102 closes as aforesaid, one side of LED 110 is connected to battery negative The other side of this LED is connected to battery positive through resistor 96. Hence in the "off" mode, current will flow through LED 110 causing the same to light. LED 110 then serves to indicate that current is flowing through the contacts of relay 102 and that the inventive device is in this "off" mode. Diodes 84 and 114 operate to prevent both LEDs 94 and 110 from lighting simultaneously when the inventive apparatus is in either the "on" or "off" mode.

Programmable timer 60 is one of many such store-bought devices A suitable timer is the Radio Shack$^R$ Micronta programmable clock-timer, catalog or item number 63-888 (1988 Catalog, at pg. 119). This timer is equipped with a remote 9 volt DC relay (seen as numeral 66 in FIGS. 3–5) that is rated for 15 amps at 120 VAC. Timer 60 is designed to time household appliances by switching household current with this relay. The timer is modified by removing the 120 VAC connections from the switched, normally open contacts of (its) relay 66. The contacts of this relay are then respectively connected to leads 68 and 78 for operation as described above.

Switch 76 is a "manual/timer" mode selection switch and it is closed during automatic (timer) operation of the inventive apparatus. To manually override automatic timer control (i.e., stop automatic operation of the instant device), switch 76 is manually opened. "Manual" control or operation of wall switch 14 is then achieved by opening or closing switch 122. That is to say, when switch 122 is closed manually, the electrical effect will be the same as if the contacts of relay 66 close—current will be supplied to motor 36 (as described above with reference to FIG. 4) until switch lever 26 is driven to its 'on' position. And, when switch 122 is opened manually, the electrical effect will be the same as if the contacts of relay 66 open—current will be supplied to motor 36 (as described above with reference to FIG. 5) until switch lever 26 is driven to its 'off' position.

Relays 70 and 102 are typically 5 volt DC units supplied by many vendors. The voltage and current rating of battery 74 is designed to correlate with the power required by the inventive apparatus as a whole and particularly relays 66, 70 and 102. A suitable voltage for battery 74 is 9 volts and the battery should be one of the more powerful types such as alkaline, lithium, NiCad, or gelled acid. And, it will be readily apparent to those in the art that relays 66, 70, and 102 can be replaced by their solid state equivalents, or that the operation of the relays can be implemented in standard logic blocks (e.g., AND, NAND, and NOR gates) driving solid state switches Turning now to FIG. 6 there is shown, in diagrammatic form, another embodiment of the present invention. A solenoid 130 is mounted on a plate 728 by means of a bracket 132. Plate 728 is attached to the switch unit or cover plate 12 in a manner similar to that described above with reference to plate 28 of FIGS. 1–5. Solenoid 130 includes a relatively moveable plunger 134. One end of the plunger, end **134*a*, is formed so as t engage the type of switch mechanism that extends through cover plate 12. In this example, the mechanism is shown as conventional lever 26. Hence end 134*a* is in the form of a double "L." The plunger body also includes a stop 134*b*. The other end of the solenoid plunger, end 134*c*, is formed with an end cap 136. A spring 138 biases plunger body 134, relatively downwardly when looking at FIG. 6, by reacting against cap 136. A lead 140 connects one end of the solenoid winding to the negative terminal of a battery 774. A solid state switching device 142, which in this case is shown as an NPN transistor, has its collector coupled to the positive terminal of battery 774 by means of a lead 144. A lead 146 couples the emitter of transistor 142 to the other end of the solenoid winding or coil. This lead should include standard techniques (not shown) for decoupling any inductive spikes that appear on the lead when solenoid 130 is switched on and off. Such techniques include the parallel combination of a reversed biased diode and a despiking capacitor connected from lead 146 to ground. A programmable timer 148 obtains power from battery 774 by means of leads 150 and 152. One end of a lead 154 is coupled to the output of timer 148. The other end of lead 154 is connected to the base of transistor 142. Lead 154 is driven by timer 148 and when so driven, applies a small base current to transistor 142** turning the same on during use and operation as will be described now.

Figure 6:
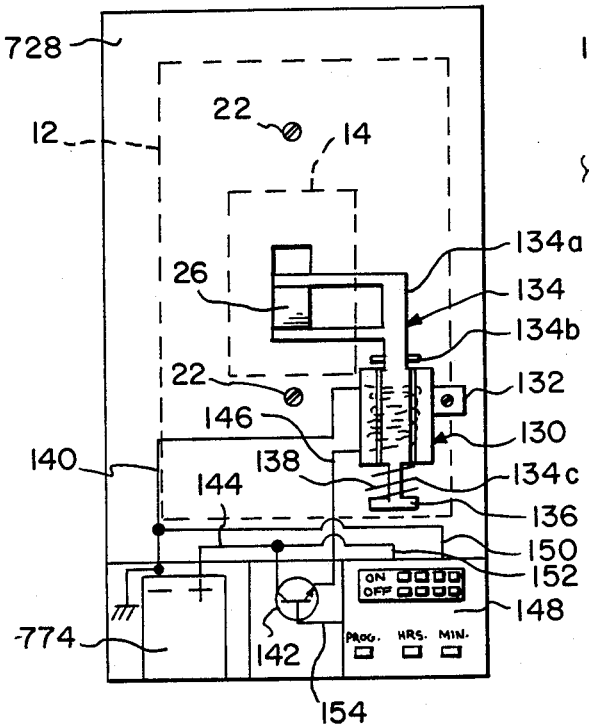
FIG. 6 is a diagrammatic front view of another embodiment of the present invention showing how the DC motor and linkage can replaced by a solenoid.

In use and operation of the embodiment of FIG. 6, timer 148 is programmed for a given "on" time and a given "off" time by means of the program buttons shown, and as is common with such timers. When in the "off" mode, the timer keeps lead 154 at a logic lower substantially at ground potential. This cuts off NPN transistor 142. Since no current is flowing in the winding of solenoid 130, spring 138 maintains and urges plunger 134 in the position shown in FIG. 6 with its relative downward travel or position limited by stop **134*b* reacting against the plunger body. This keeps switch mechanism 14** at its "off" position.

At the preprogrammed "on" time, timer 148 drives lead 154 to a logic high or applies a positive bias thereto. This positive bias on lead 154 applies base current to transistor 142 turning the same fully on and sending battery current into lead 146 and the winding of solenoid 130. The magnetic interaction associated with solenoid 130 and plunger 134 lifts or drives the latter relatively upwardly overcoming the opposing force of spring 138. The upward travel of plunger 134 lifts lever 26 to its "on" position thus turning on switch 14. It will be apparent that, during this on time, lead 154 remains at a logic high or supplied with base bias and that transistor 142 is, preferably, driven into saturation.

After a given interval and at the preprogrammed "off" time, lead 154 is driven to the aforesaid logic low by operation of timer 148. This shuts off transistor 142 causing the magnetic field associated with solenoid 130 to collapse. Spring 138 nearly immediately drives plunger 134 back to its retracted and down position bringing with it switch lever 26 and turning off switch 14.

Solid state means 142 can be one of a variety of devices such as a bipolar (NPN or PNP) transistor, power FET, SCR and the like. The voltage chosen for battery 774 is not critical and can be of any value associated with solid state devices. However, an important design criteria for the battery is that it have sufficient current capacity to operate the timer and solenoid for intermittent use. An alkaline, rechargeable NiCad, or Lithium battery is a suitable choice. Indeed, battery 774, and for that matter battery 74 of FIGS. 1–5, can be replaced by a small AC socket mounted DC supply. In certain applications and with certain solenoids it may be desirable to interpose a current limiting resistor (not shown) in series with the circuitry associated with the driving of solenoid 130 (i.e., transistor 142, battery 774, and leads 140, 144, and 146).

Figure 7:
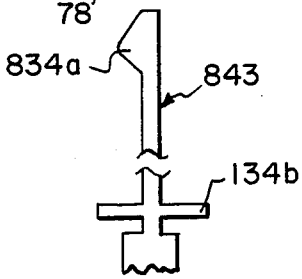
FIG. 7 is a side view of another type of link that can used to activate a rocker driven wall switch; and, FIG. 8 is a diagrammatic illustration showing how a wireless link can be integrated into the inventive structure.

Turning now to FIG. 7 there is shown a solenoid plunger 834 that can be used to operate rocker type wall switches. In the embodiment of FIG. 7, end **134*a* of the plunger seen in FIG. 6 is modified and formed with a protrusion 834*a*. Protrusion 834*a* is designed to engage and trip a switch rocker (not shown) of a conventional rocker operated wall switch. Of course link 56 of FIG. 1 is easily modified (and supported) so as to carry the type of end shown in FIG. 7. In fact the noted end of either link 56 or plunger 134** can be modified for complementary engagement with practically any type of wall switch.

While plates 28 and 728 are shown being supported by respective screws 22, means such as double sided pressure sensitive adhesive tape can be used to secure plates 28 and 728 to either wall 18 or cover plate 12. Or, for example, plate 728 can be detachably secured directly to wall 18 by conventional wall screws. And, of course, an additional "on/off" switch (not shown) can be serially connected with either terminal of battery 774 (or batter 74) for master control of the inventive actuator.

Figure 8:
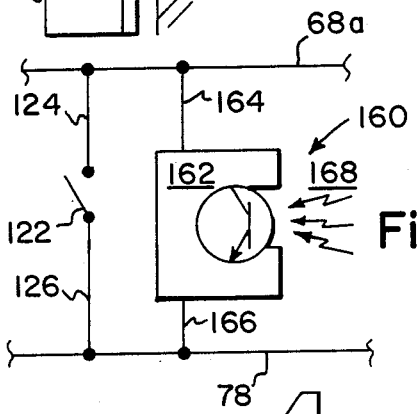

Turning now to FIG. 8 there is shown how a more or less conventional wireless link 160 can be integrated into the circuitry of FIG. 3. As shown in FIG. 8, link 160 includes a wireless receiver 162 placed across leads **68*a* and 78 by means of respective leads 164 and 166**. A conventional complementary wireless transmitter (not shown) is manually activated during use and operation as will be described now.

In use and operation of the embodiment of FIG. 8, switch 76 is opened. As noted above, this interrupts timer control. The operation link 160 i, in effect, a wireless implementation of the operation of switch 122. That is to say, when the remote wireless transmitter fires energy 168 at receiver 162, the receiver will flip or toggle between placing a short or low impedance path across leads **68*a* and 78, and placing a open circuit or high impedance across the last-mentioned leads. This operation of receiver 162 will essentially mimic operation of switch 122, as described above. Hence a burst of wireless energy directed at receiver 162 will have the same effect as if the contacts of relay 66 close—namely, motor 36 will be powered until switch lever 26 is driven to its 'on' position. While a subsequent burst of energy directed at receiver 162 will have the same effect as if the contacts of relay 66 open—namely, motor 36 will be powered until switch lever 26** is driven to its 'off' position.

The type of wireless link employed by means 160 includes all forms of electromagnetic energy including infrared, visible light, and RF energy. Indeed, link 160 might also include sonic and ultra-sonic energy. And, it is to be understood that the application of means 160 into the embodiment of FIG. 3 is illustrative only. For means 160 is readily integrated into the structure of FIG. 6 (where it would, for example, drive the base of transistor 142).

Although the inventive device is shown operating a wall switch the instant device will also find use in controlling the master switch of hot water heaters, furnaces and the like. And, it is to be understood that "timed" operation of the inventive embodiments also includes random operation of same.

While only a few embodiments of the present invention have been shown and described, it is to be understood that many changes and modifications can be made hereto without departing from the spirit and scope hereof.

What is claimed is:

1. A remotely controlled actuator for operation of a conventional wall switch unit wherein part of the switch mechanism thereof extends from the wall and wherein the actuator is signaled by a wireless transmitter comprising plateform means adapted to be detachably secured in abutting relation with the switch unit, an electrically powered motor carried on said plateform means, linkage means carried on said plateform means and driven by said motor for moving the switch mechanism part between its 'off' and 'on' positions, and wireless operated switch means for applying electric power to said motor, the last-mentioned means including solid-state means adapted to toggle between an open or high impedance state and a closed or low impedance state and thereby switch electric power to said motor, said wireless operated switch means being responsive to the energy of the transmitter whereby when the latter signals the former, said solid-state means toggles from one given state to another whereby electric power is applied to said motor thus to cause the switch mechanism part to move from its one given position to another.

2. An electrically powered actuator that uses a programmable timer for timed movement of the switch mechanism of a conventional wall switch and that is detachably affixed in abutting relation to the cover plate thereof comprising housing means, a small motor carried in said housing means, linkage means driven by said motor and adapted to engage the switch mechanism, relay means for switching electric power to said motor, said relay means including a timer-driven relay the solenoid coil of which is driven by the programmable timer and whose contacts are normally open, an on-cycle relay whose contacts are normally open, an off-cycle relay whose contacts are normally closed, said on-cycle and off-cycle relays having their respective solenoid coils in circuit with the contacts of said timer-driven relay and electric power, said motor in circuit with the contacts of said on-cycle and off-cycle relays and electric power, whereby, at a preset time, the programmable timer operates said timer-driven relay closing the contacts of same thus to operate said on-cycle relay and said off-cycle relay, such operation closing the contacts of said on-cycle relay and opening the contacts of said off-cycle relay whereby current is applied to said motor causing said linkage means to move the switch mechanism in its 'on' direction of travel, and, at another preset time, the programmable timer interrupts operation of said timer-driven relay opening the contacts of same thus to interrupt operation said on-cycle relay and said off-cycle relay, such interruption opening the contacts of said on-cycle relay and closing the contacts of said off-cycle relay whereby current is applied to said motor causing said linkage means to move the switch mechanism in its 'off' direction of travel, and secondary switch means carried on said housing, the last-mentioned means in circuit with said motor and electric power for interrupting current to said motor when the switch mechanism reaches its respective 'on' or 'off' extreme of travel.

3. The actuator of claim 2, said linkage means including means for converting the rotary motion of said motor to small linear displacement.

4. The actuator of claim 2, said secondary switch means including two micro-switches, one of said micro-switches being operated by said linkage means when the switch mechanism reaches its 'on' extreme of travel, the other of said micro-switches being operated by said linkage means when the switch mechanism reaches its 'off' extreme of travel.

* * * * *